US008349438B2

(12) United States Patent
Laib et al.

(10) Patent No.: US 8,349,438 B2
(45) Date of Patent: Jan. 8, 2013

(54) INSULATIVE MATERIAL AND ASSOCIATED METHOD OF FORMING SAME

(75) Inventors: Trevor M. Laib, Woodinville, WA (US); Henry V. Fletcher, III, Everett, WA (US); Bradley J. Mitchell, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 333 days.

(21) Appl. No.: 11/968,940

(22) Filed: Jan. 3, 2008

(65) Prior Publication Data

US 2009/0176054 A1 Jul. 9, 2009

(51) Int. Cl.

| | |
|---|---|
| ***B32B 3/10*** | (2006.01) |
| ***B32B 7/02*** | (2006.01) |
| ***B32B 37/00*** | (2006.01) |
| *B32B 5/08* | (2006.01) |
| *B32B 5/14* | (2006.01) |
| *B32B 5/26* | (2006.01) |

(52) U.S. Cl. ..... 428/212; 428/101; 428/114; 428/292.1; 428/297.7; 428/299.7; 428/300.4; 428/300.7; 428/365; 428/373; 428/397; 428/399; 428/913; 428/137; 428/189; 156/60

(58) Field of Classification Search ..... None
See application file for complete search history.

(56) References Cited

U.S. PATENT DOCUMENTS

| | | | | |
|---|---|---|---|---|
| 3,272,901 | A | 9/1966 | Sims | |
| 3,607,591 | A | 9/1971 | Hansen | |
| 4,661,404 | A * | 4/1987 | Black | 428/369 |
| 6,312,784 | B2 * | 11/2001 | Russell et al. | 428/101 |
| 6,767,850 | B1 * | 7/2004 | Tebbe | 442/76 |
| 7,291,389 | B1 * | 11/2007 | Bitler et al. | 428/373 |
| 7,428,772 | B2 * | 9/2008 | Rock | 28/159 |
| 7,743,476 | B2 * | 6/2010 | Rock et al. | 28/160 |
| 8,028,386 | B2 * | 10/2011 | Rock et al. | 28/160 |
| 8,187,984 | B2 * | 5/2012 | Rock | 442/64 |
| 2001/0008821 | A1 * | 7/2001 | Russell et al. | 442/181 |
| 2005/0208857 | A1 * | 9/2005 | Baron et al. | 442/327 |
| 2005/0246813 | A1 * | 11/2005 | Davis et al. | 2/69 |

(Continued)

FOREIGN PATENT DOCUMENTS

| | | | |
|---|---|---|---|
| EP | 1894482 | A | 3/2008 |

(Continued)

OTHER PUBLICATIONS

Barry A. Morris, Reducing Curl in Multilayer Blown Film: Experimental Results, Model Development, and Application to a Cereal Liner Film, *Journal of Plastic Film and Sheeting*, vol. 19, No. 1, pp. 31-54, <http:/www.jpf.sagepub.com/cgi/content/abstract/19/1/31> (visited Jan. 3, 2008).

(Continued)

*Primary Examiner* — Maria Veronica Ewald
*Assistant Examiner* — Jeff Vonch
(74) *Attorney, Agent, or Firm* — Alston & Bird LLP

(57) ABSTRACT

An insulative material and a method of forming the insulative material are provided. The insulative material is configured to change shape in response to temperature and thus, for example, the insulative material may become more insulative as the temperature decreases. For example, the insulative material may include a plurality of fibers that change shape, such as by curling, in response to decreases in temperature, thereby correspondingly changing the insulative properties.

19 Claims, 8 Drawing Sheets

U.S. PATENT DOCUMENTS

Figure 1:
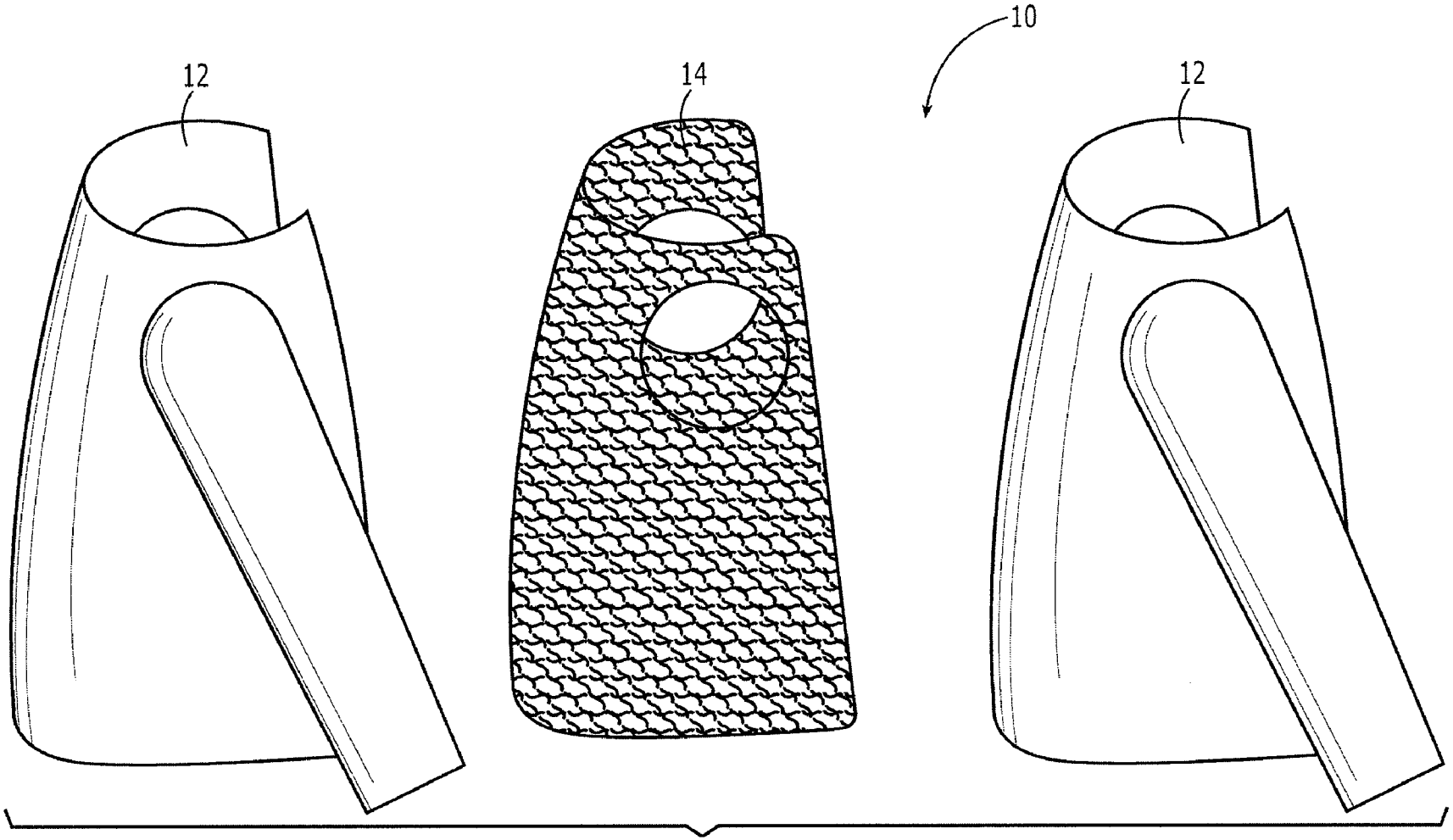

| | | | | |
|---|---|---|---|---|
| 2006/0277950 | A1* | 12/2006 | Rock | 66/169 R |
| 2008/0057261 | A1* | 3/2008 | Rock | 428/85 |
| 2008/0075850 | A1 | 3/2008 | Rock | |

FOREIGN PATENT DOCUMENTS

| | | | |
|---|---|---|---|
| GB | 2234705 | A | 2/1991 |
| WO | WO 95/12553 | | 5/1995 |
| WO | WO 9905926 | A | 2/1999 |

OTHER PUBLICATIONS

International Search Report for PCT/US2008/081412, dated Mar. 5, 2009.

Written Opinion for PCT/US2008/081412, dated Mar. 5, 2009.

* cited by examiner

INSULATIVE MATERIAL AND ASSOCIATED METHOD OF FORMING SAME

BACKGROUND OF THE INVENTION

Embodiments of the present invention relate generally to insulative materials and, more particularly, to insulative materials configured to change shape in response to changes in temperature, as well as associated methods for forming the insulative materials.

Insulative materials are utilized in a wide variety of applications. For example, spacecraft and other air vehicles commonly include insulation for protecting the occupants and/or the cargo from the relatively extreme temperatures that may otherwise be experienced. As another example, clothing, such as jackets, may include one or more layers of insulation to assist the wearer in remaining warm when in a cold climate. While the insulation utilized by spacecraft, clothing and other applications may generally be suitable for relatively static thermal conditions, the insulation may become unsuitable or unnecessary as the thermal conditions change, such as in instances in which the ambient temperature becomes warmer, in instances in which the wearer of an insulated jacket exercises or otherwise increases their metabolic rate or in instances when the radiant heat load changes, as would occur when going from shade into full sun. Indeed, since insulated clothing generally has a fixed thermal resistance, wearers may become too hot or too cold as the ambient temperature changes, the metabolic rate of the wearer varies or the radiant heat load changes. In instances in which the wearer becomes too hot, the wearer can remove the clothing, but is then burdened with having to carry or otherwise account for the clothing which has been removed.

Some clothing has been designed in an effort to alter the thermal resistance of the clothing as conditions change. For example, some skiwear includes vents that can be opened or closed. When open, the vents allow air to flow around the insulation layer to cool the wearer. As such, a skier can open the vents in their clothing as the temperature increases, as the metabolic rate of the skier increases following one or more runs, or as the radiant heat load increases. Conversely, the skier can close the vents to restrict airflow around the insulation layer so as to allow the skier to remain warmer, such as in instances in which temperature decreases, the metabolic rate of the skier drops or the radiant heat load decreases. A ski jacket has also been developed having pull strings that, when pulled, displace insulating material within the jacket and, therefore, alter the insulation characteristics of the jacket.

While the foregoing skiwear does provide at least some modification of the insulation characteristics of the skiwear, this skiwear still only provides acceptable insulation over a relatively small range of temperatures, metabolic rates and radiant heat loads and, as such, is unable to fully accommodate greater changes in either temperature, metabolic rate and/or radiant heat load. Further, the foregoing skiwear requires manual intervention by the wearer, which may be undesirable in some circumstances or which may be overlooked or forgotten by the wearer in other instances.

Accordingly, it would be desirable to develop an improved insulative material that is configured to provide variable insulation characteristics, thereby providing appropriate insulation even as the thermal characteristics change, such as with changing temperature, metabolic rate and/or radiant heat load.

BRIEF SUMMARY OF THE INVENTION

An insulative material and a method of forming the insulative material are provided according to various aspects of the present invention. The insulative material is configured to change shape in response to temperature and thus, for example, the insulative material of one embodiment may become more insulative as the temperature decreases. Thus, the insulative material as well as an adaptive clothing article that incorporates the insulative material may permit a wearer to remain comfortable over a broader range of temperatures since the insulative material may be less insulative and therefore permit the wearer to remain cooler at warmer temperatures, while being more insulative and thereby keeping the wearer warmer at cooler temperatures. Alternatively, the insulative material may be tuned to become more insulative as the temperature increases, as may be desirable for clothing to protect against hot temperatures, as is used, for example, by firefighters.

According to one aspect of the present invention, an adaptive insulative material is provided that is formed of at least first and second structural components with the first and second structural components being joined together and comprised of first and second materials, respectively. The first and second materials have different coefficients of thermal expansion such that the insulative material is configured to change shape in response to changes in temperature. The adaptive insulation of one embodiment may also include a non-adaptive insulative material with which the insulative material is integrated.

In one embodiment, the insulative material includes a plurality of fibers with some portion of the fibers comprised of at least first and second materials having different coefficients of thermal expansion. As a result, each fiber is configured to change shape, such as by curling or otherwise deforming, in response to changes in temperature. In this regard, each fiber may be configured to expand in at least one dimension in response to changes in the temperature such that the plurality of fibers develop larger and/or more numerous voids between the fibers and the insulative material correspondingly becomes more insulative.

In one embodiment, the first and second materials both extend lengthwise along the respective fibers. At least one of the first and second materials may vary in at least one of relative position, shape or size in a lengthwise direction along the respective fibers. In another embodiment, each of the plurality of fibers has a neutral temperature with the fiber being configured to change shape as the temperature varies from the neutral temperature. In this embodiment, the plurality of fibers can include first and second sets or layers of fibers with first and second different neutral temperatures, respectively. As such, the insulative material of this embodiment will include fibers that change shape within different temperature ranges so as to permit the insulative material to be useful over an even broader range of temperatures.

In one embodiment, the first structural component may include a sheet formed of the first material. In this embodiment, the second structural component may include a plurality of pieces of the second material disposed on the sheet and spaced apart from one another. At least one of the first and second structural components of this embodiment may also define at least one opening that changes between open and closed configurations in response to the change in shape of the insulative material. In another embodiment in which the first structural component includes a sheet formed of the first material, the second structural component may be joined to only a portion of the sheet, such as in the form of a fiber seam, to thereby limit the manner in which the sheet expands since the second material that forms the second structural component has a lower coefficient of thermal expansion than the first material.

According to another aspect of the present invention, a method of forming adaptive insulation is provided. The method forms an adaptive insulative material from at least first and second structural components. The first and second structural components are joined together and are formed of first and second materials, respectively, that have different coefficients of thermal expansion. As such, the insulative material is configured to change shape in response to changes in temperature. The method may also integrate the adaptive insulative material with a non-adaptive insulative material.

In one embodiment, the insulative material is formed from a plurality of fibers with each fiber formed of the first and second structural components. Each of the plurality of fibers may be have a neutral temperature and the fiber may be configured to change shape as the temperature varies from the neutral temperature. As such, the insulative material may be formed from first and second sets of fibers that have first and second different neutral temperatures, respectively.

In another embodiment, the first structural component may include a sheet formed of the first material and the second structural component may include a plurality of pieces of the second material. As such, the insulative material may be formed by joining the plurality of pieces of the second material to the sheet with the plurality of pieces being spaced apart from one another. At least one opening may be defined in at least one of the first and second structural components. In this regard, the opening(s) may be configured to change between open and closed configurations in response to the change in shape of the insulative material. In another embodiment in which the first structural component includes a sheet formed of the first material, the insulative material may be formed by joining the second structural component to only a portion of the sheet such that the sheets are forced apart due to the differing thermal expansions of the two materials.

BRIEF DESCRIPTION OF THE SEVERAL VIEWS OF THE DRAWING(S)

Figure 2A:
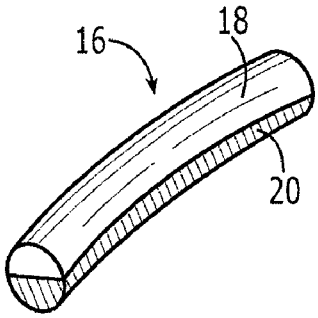
Figure 2B:
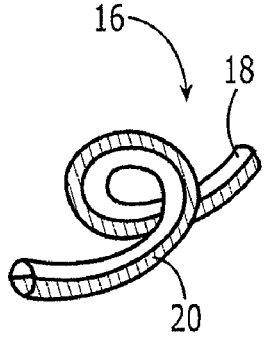
Figure 3:
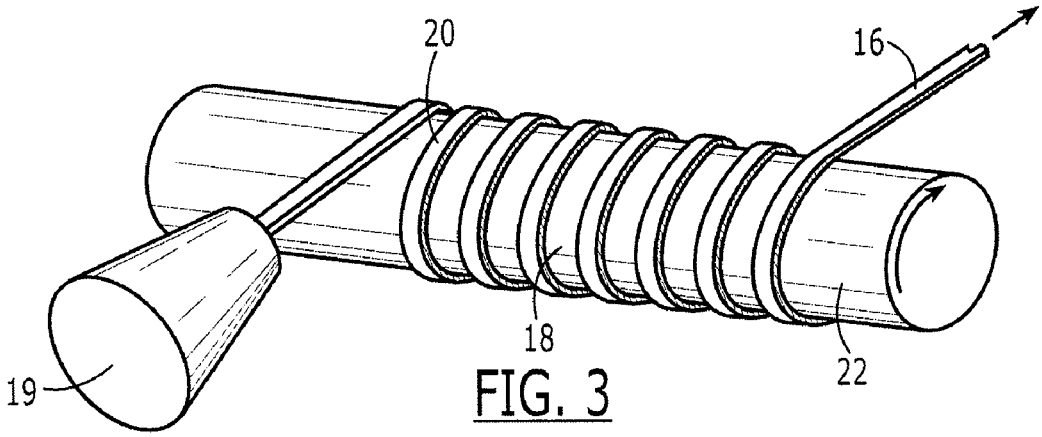
Figure 4A:
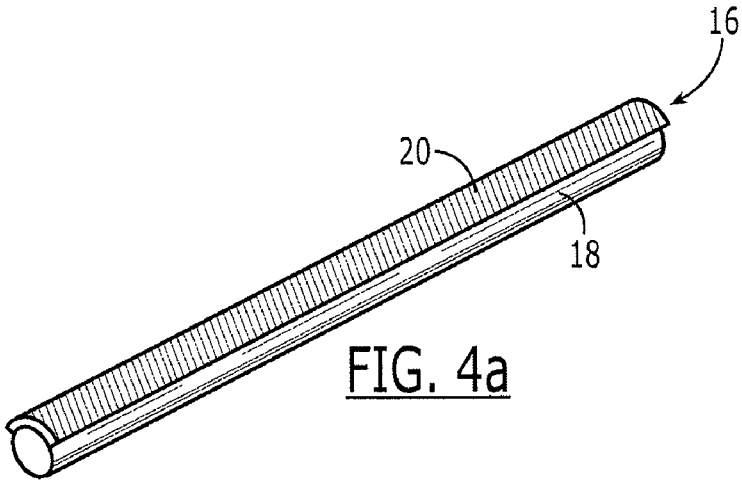
Figure 4B:
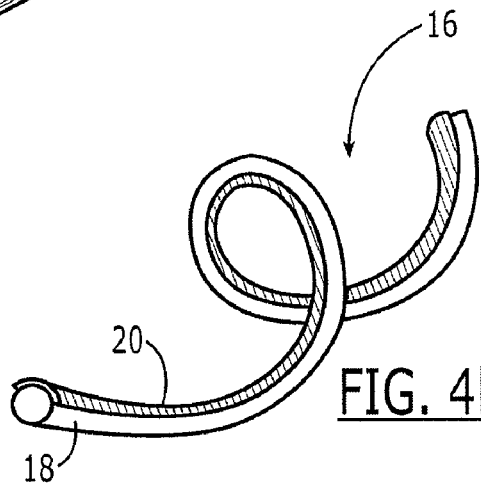
Figure 5A:
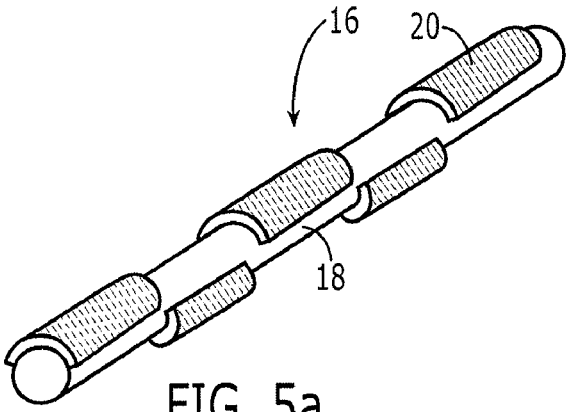
Figure 5B:
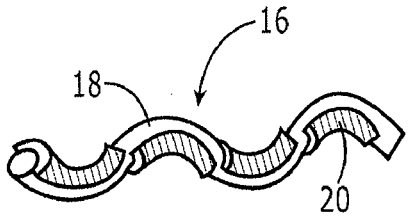
Figure 6A:
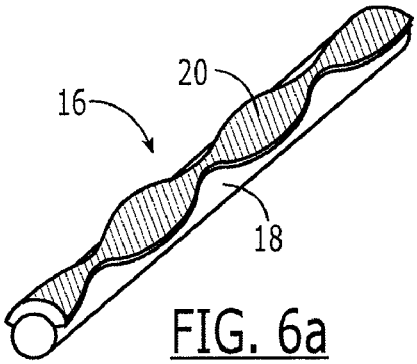
Figure 6B:
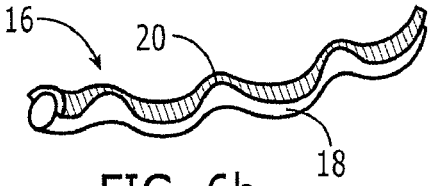
Figure 7A:
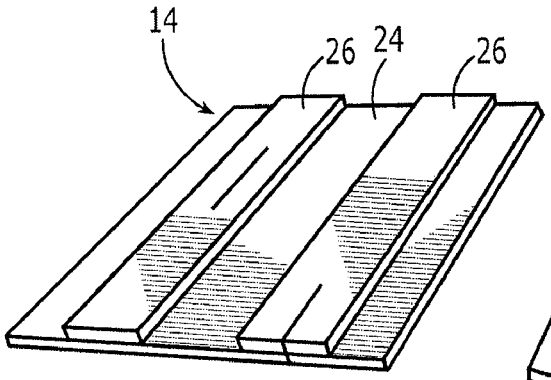
Figure 7B:
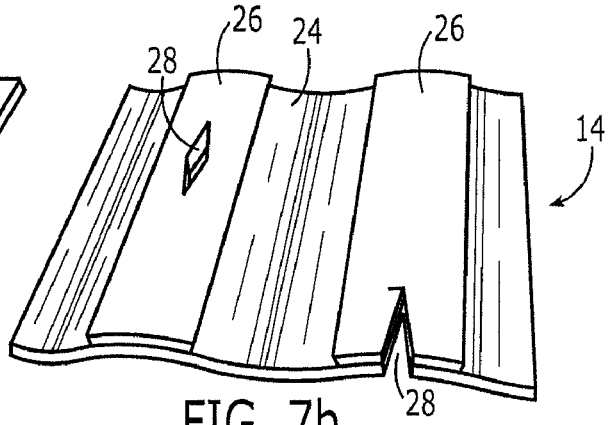
Figure 8A:
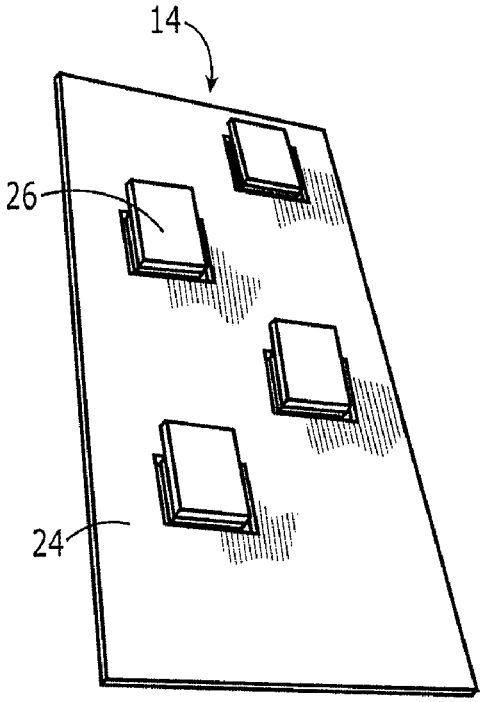
Figure 8B:
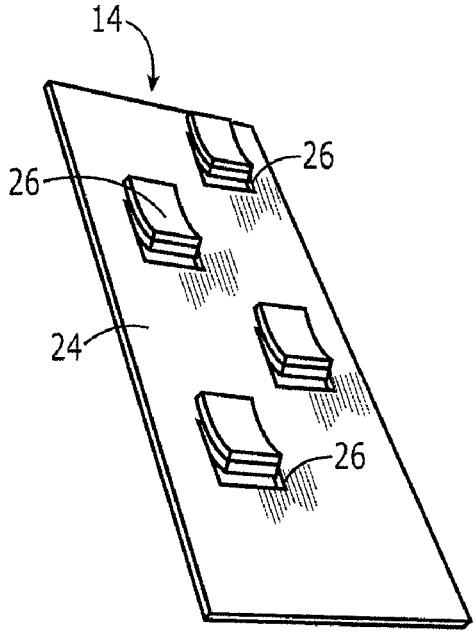
Figure 9A:
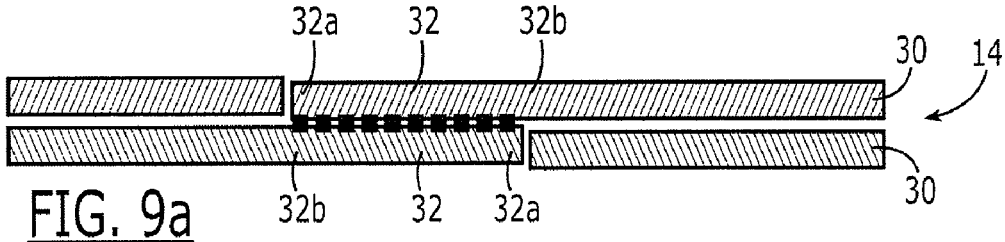
Figure 9B:
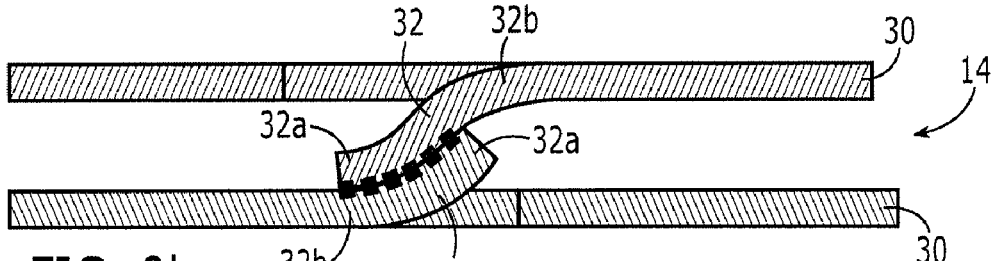
Figure 10A:
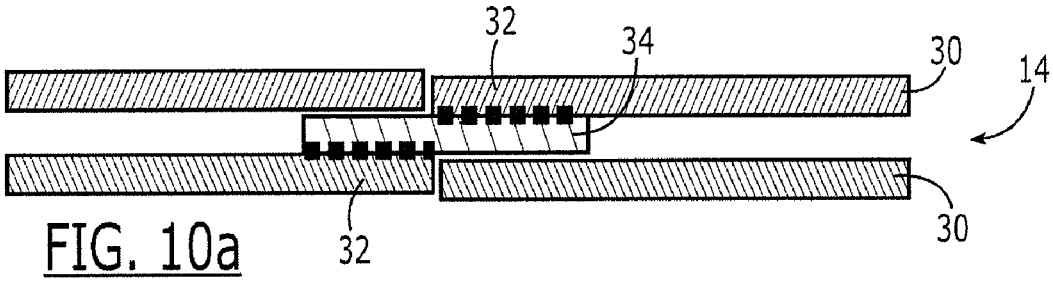
Figure 10B:
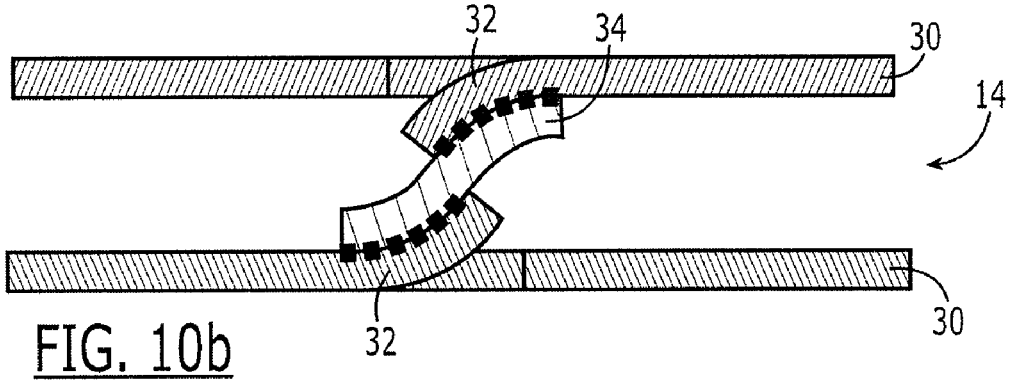
Figure 11A:
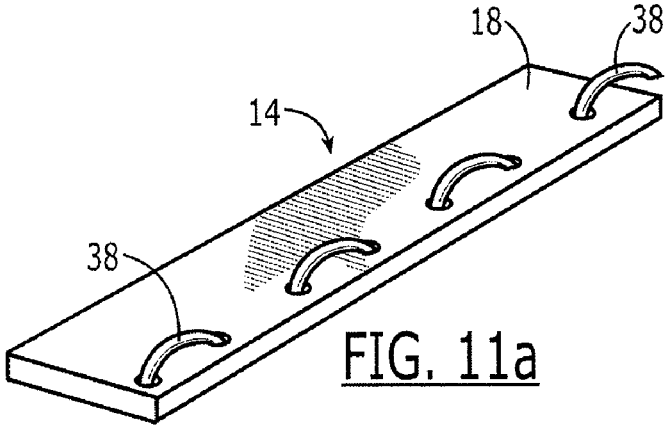
Figure 11B:
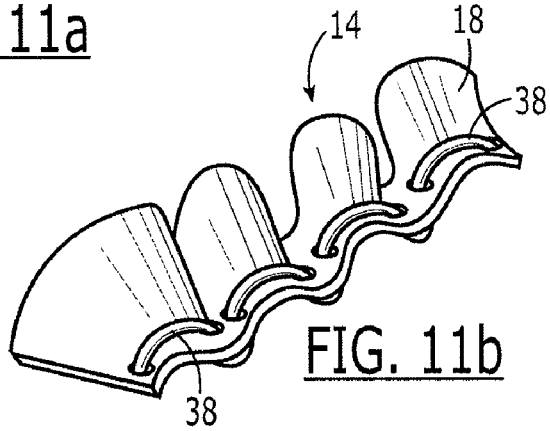
Figure 12:
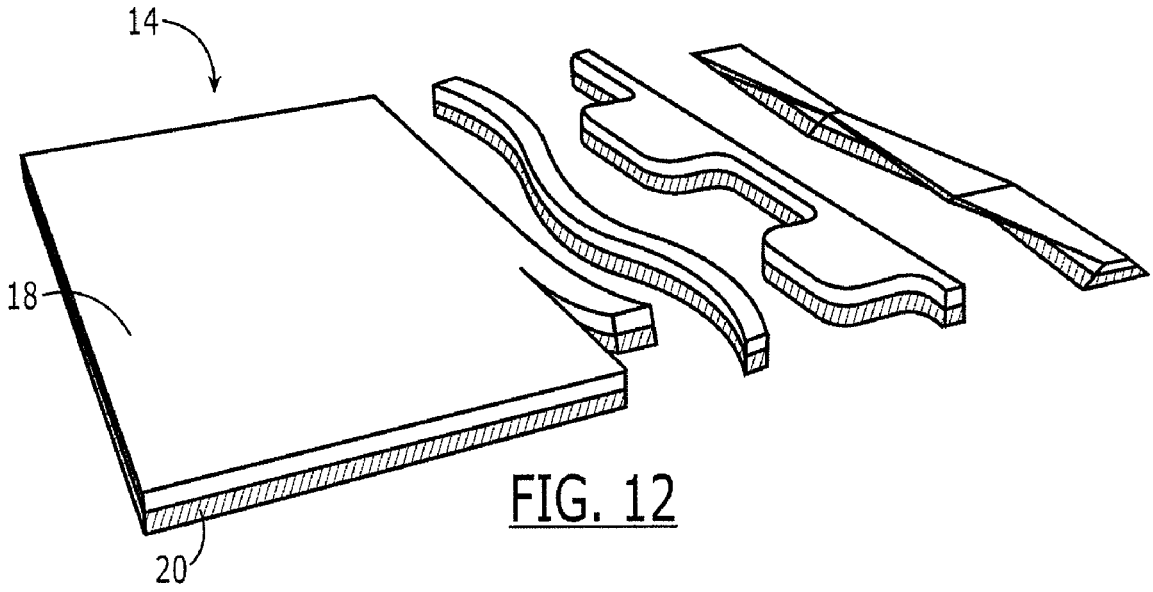
Figure 13A:
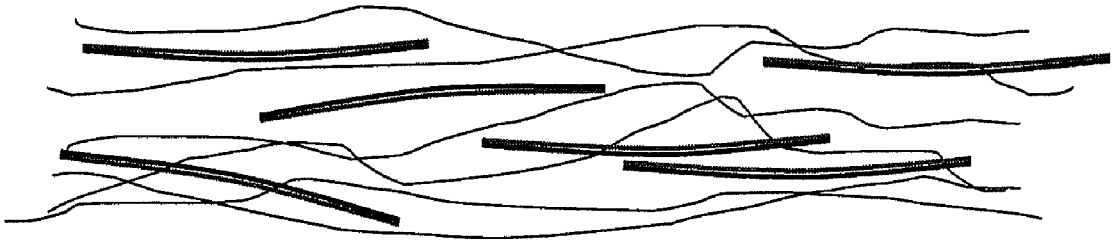
Figure 13B:
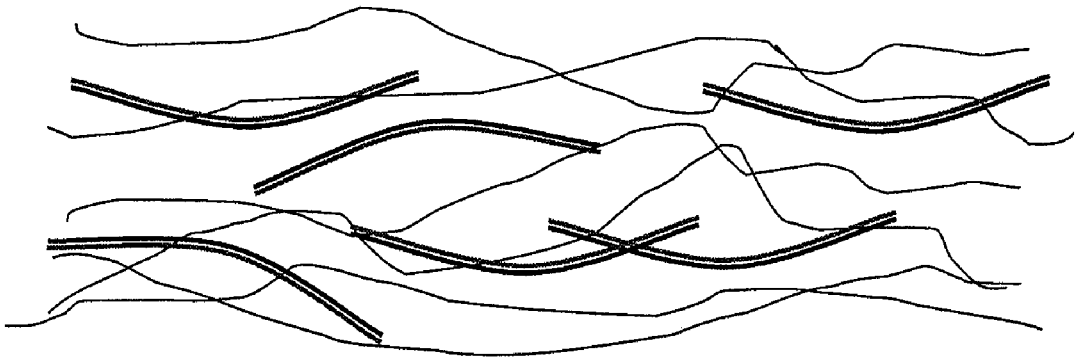
Figure 14A:
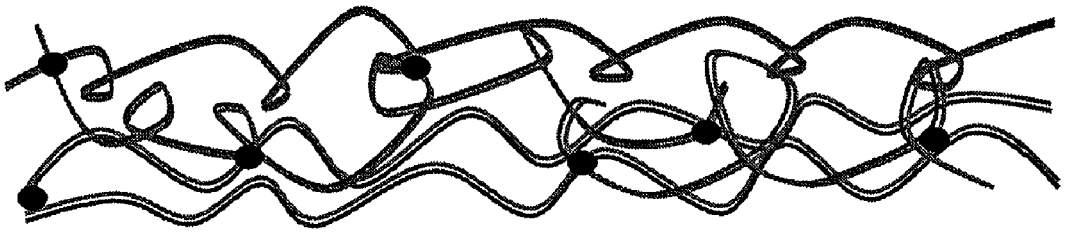
Figure 14B:
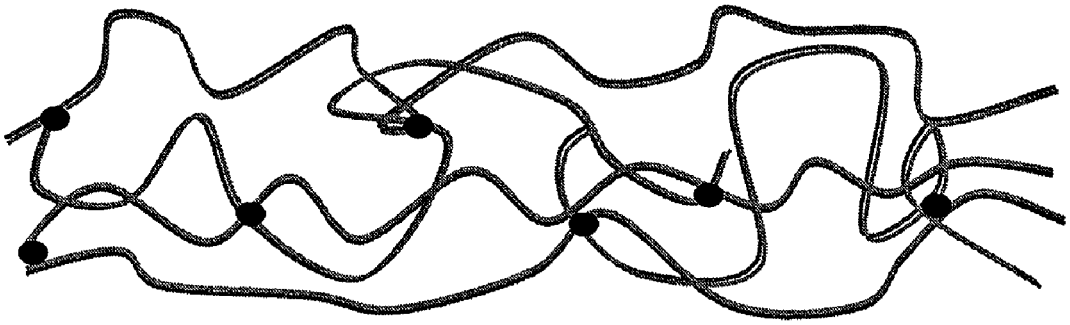

Having thus described the invention in general terms, reference will now be made to the accompanying drawings, which are not necessarily drawn to scale, and wherein:

FIG. 1 is an exploded perspective view of an article of clothing, such as a jacket, worn by a wearer and fabricated in accordance with embodiments of the present invention;

FIGS. 2*a*, and 2*b*, are perspective views of a straight fiber and a curled fiber, respectively, in accordance with one embodiment of the present invention;

FIG. 3 is a perspective view of an extruded fiber being wound upon a spool in accordance with embodiments of the present invention;

FIGS. 4*a*, and 4*b*, are perspective views of a straight fiber and a curled fiber, respectively, in accordance with another embodiment of the present invention;

FIGS. 5*a*, and 5*b*, are perspective views of a straight fiber and a curled fiber, respectively, in accordance with a further embodiment of the present invention;

FIGS. 6*a*, and 6*b*, are perspective views of a straight fiber and a curled fiber, respectively, in accordance with yet another embodiment of the present invention;

FIGS. 7*a*, and 7*b*, are perspective views of an insulative material in accordance with another embodiment of the present invention;

FIGS. 8*a*, and 8*b*, are perspective views of an insulative material in accordance with yet another embodiment of the present invention;

FIGS. 9*a*, and 9*b*, are side views of an insulative material in accordance with another embodiment of the present invention;

FIGS. 10*a*, and 10*b*, are side views of an insulative material in accordance with yet another embodiment of the present invention;

FIGS. 11*a*, and 11*b*, are perspective views of an insulative material in accordance with a further embodiment of the present invention;

FIG. 12 is a perspective view of yet another embodiment of an insulative material in accordance with the present invention;

FIGS. 13*a*, and 13*b*, are schematic representations of an insulative material in accordance with one embodiment of the present invention at the neutral temperature and away from the neutral temperature, respectively; and FIGS. 14*a*, and 14*b*, are schematic representations of an insulative material in accordance with another embodiment of the present invention at the neutral temperature and away from the neutral temperature, respectively.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, an article of clothing 10 fabricated in accordance with embodiments of the present invention is depicted. Although the article of clothing is shown to be a jacket, a wide variety of other articles of clothing can be fabricated in accordance with embodiments of the present invention. Additionally, while the insulative material of embodiments of the present invention will generally be described in conjunction with the fabrication of an article of clothing, the insulative material may be employed in a wide variety of other applications including, for example, the use of the insulative material to provide thermal protection to a spacecraft or other vehicle or the like.

With reference to FIG. 1, for example, an article of clothing 10 formed in accordance with one embodiment of the present invention includes first and second clothing layers 12 defining a pocket, such as a void, therebetween. As in the illustrated embodiment, the first and second clothing layers may be the inner and outer layers of the article of clothing. Alternatively, one or both of the first and second clothing layers may be inner layers disposed within the interior of the jacket or other article of clothing. The jacket of FIG. 1 also includes an adaptive insulative material 14 disposed between the first and second clothing layers, such as within the pocket defined between the first and second clothing layers. As described below, the insulative material is configured to change shape in response to changes in temperature so as to provide varied degrees of insulation at different temperatures. In one advantageous embodiment, for example, the insulative material is designed to provide less insulation at warmer temperatures such that the wearer remains cooler, and more insulation at colder temperatures such that the wearer remains warmer. As will be apparent in the following discussion, the temperature that affects the change in shape of the insulative material is the temperature to which the insulative material itself is exposed and is, therefore, generally a combination of the ambient temperature and the body temperature of the wearer. As such, even in instances in which ambient temperature remains relatively cold, a wearer who is performing exercise or other tasks which raise their metabolic rate and therefore increase the body temperature of the wearer will tend to correspondingly increase the temperature to which the insulative material is exposed and cause the insulative material to change shape in such a manner as to provide less insulation, thereby permitting the wearer to be cooled somewhat by the relatively cold ambient temperature so as to avoid overheating from the exercise or other activity.

The adaptive insulative material 14 can be fabricated in various manners as will be described below. In each of the various embodiments, however, the insulative material is formed of at least first and second structural components. The first and second structural components are joined together and are, in turn, comprised of first and second materials, respectively. The first and second materials have different coefficients of thermal expansion and, as such, the insulative material correspondingly changes shape in response to changes in temperature in order to change the thermal conductivity of the insulative material. Although not required, the thermally adaptive insulative material of embodiments of the present invention is typically disposed within or otherwise integrated with non-adaptive insulative materials such that the change in shape of the thermally adaptive insulative material also alters the thermal performance of the non-adaptive insulative materials. As used herein, non-adaptive insulative materials are those insulative materials, such as yarn, that may change size by expanding and contracting as the temperature increases and decreases, respectively, but do not change shape, e.g., by curling or straightening, such as occasioned by the formation of the adaptive insulative material of the first and second structural components.

In one embodiment, the insulative material 14 is formed of a plurality of fibers 16 with each fiber formed of first and second structural components 18, 20. In other words, each fiber is formed of a first portion, i.e., a first structural component, comprised of the first material and a second portion, i.e., a second structural component, comprised of the second material, as shown in FIG. 2*a*. As noted above, the first and second materials may have different coefficients of thermal expansion. While the fibers may be formed in various manners, the fibers may be extruded with the first and second materials being co-extruded. While the fibers may be formed of various combinations of materials, the fiber of one embodiment is formed of polyethylene that is co-extruded along with another polymer, such as nylon, or with polyethylene that has been modified by cross-linking in such a manner as to alter its coefficient of thermal expansion. Alternatively, the fiber could be formed by co-extruding silica glass fibers with some other glass, for example, borosilicate glass, to form a composite fiber.

Upon exiting an extruder, the fibers will generally attempt to twist into tight coils as the temperature decreases, such as from the elevated temperature at which the extrusion process was performed to room temperature. To prevent the tight curling of the fibers, the fibers 16 may be pulled on to a spool 18 from an extrusion head 19 and held at a fixed radius while being gradually cooled below the temperature at which the plastic takes a set—typically the glass transition temperature. As shown in FIG. 3, this process may be conducted relatively continuously in which an extruded fiber is wound in a spiral configuration about a spool with the entry portion 20 of the spool about which the recently extruded fiber is wound being maintained at an elevated temperature, while the exit portion 22 of the spool from which the fiber is withdrawn or taken off is maintained at a much cooler temperature. Between the entry and exit portions of the spool, the temperature of the spool can transition from the elevated temperature of the entry portion to the cooler temperature of the exit portion.

The diameter of the spool 18 at least partially defines the neutral temperature of the resulting fiber 16. For example, if the spool had an infinite or at least a very large diameter, the fiber would be straight or relatively straight at the setting temperature, and would curl in response to decreases in the temperature as shown in FIG. 2*b*. Conversely, if the diameter of the spool is relatively small, the fiber will be curled in a first direction at the setting temperature and will be straight or relatively straight at a lower temperature, such as room temperature. Following fabrication and in response to further decreases in temperature, the fibers will curl again, albeit in the opposite direction from the direction in which the fibers curled at the setting temperature. See FIG. 2*b*. In either instance, the temperature at which the fiber is straight will be considered the neutral temperature of the fiber.

As such, the insulative material 14 may be formed such that the fibers 16 formed of the first and second materials may be straight or relatively straight at room temperature, but will then change shape, such as by expanding in at least one dimension and, more particularly, such as by curling, in response to changes in the temperature, such as decreases in the temperature. By curling or otherwise expanding in at least one dimension, the plurality of fibers develop larger and/or more numerous voids between the fibers and the insulative material becomes correspondingly more insulative as the temperature decreases. In this regard, the increase in the void fraction of the material that results form the larger and/or more numerous voids causes the conductive paths through the material to be more indirect, thus increasing its insulative properties. Thus, a jacket 10 that includes insulative material of one embodiment to the present invention in which the fibers are relatively straight at room temperature will be less insulative than that same jacket at lower temperatures since the fibers will have curled in response to the lower temperatures and become more insulative.

As noted above, the fibers 16 may be extruded and, as such, may have a variety of cross-sectional shapes and sizes including both circular and rectangular cross-sectional shapes. However, the insulative material 14 may be formed in a wide variety of other manners without departing from the spirit and scope of the present invention. For example, a conventional fiber formed of a single material may be altered along its length by application of another material along the length of the fiber so as to create regions of the fiber that have different coefficients of thermal expansion. By way of example, a vulcanizing agent may be sprayed onto a fiber that is wound upon a spool 18 or the spool itself may include a chemical that leeches into the fiber during the winding and annealing process. As before, the treated or coated fiber may be thermally set with the curvature of the spool defining the behavior of the resulting fiber in response to variations in the temperature.

As shown in FIG. 4*a*,, a fiber 16 formed of a first material 18 may also have a second material 20 painted or otherwise deposited on to the fiber in an asymmetric manner. In the illustrated embodiment, the second material is deposited or painted on to one side of the fiber, with the other side of the fiber being free of the second material. Since the first and second materials have different coefficients of thermal expansion, the fiber may be formed to be relatively straight at a neutral temperature, such as room temperature, and to curl in response to changes in temperature, such as decreases in temperature, as shown in FIG. 4*b*.

The fibers 16 can be formed in a wide variety of other manners. As shown in FIG. 5*a*,, a fiber formed of a first material 18 may have a second material 20 applied discontinuously along one or both opposed surfaces of the fiber. Alternatively, as shown in FIG. 6*a*,, a fiber formed of the first material may include a second material applied in such a manner as to have varying thicknesses and/or widths along the length of the fiber. By applying the second material in a discontinuous manner or with varying thicknesses and/or widths along the length of the fiber, the resulting fiber may be designed to transition from a relatively straight configuration at a neutral temperature, such as room temperature, to a curled or sinusoidal configuration in response to a change in temperature, such as decrease in temperature. As shown in FIGS. 5*b*, and 6*b*,, the application of the second material in a discontinuous manner or in varying thicknesses and/or widths along the length of the fiber may result in a fiber that has curls at lower temperatures that are separated by segments which do not curl or which curl in an opposite direction or to a different degree.

The fibers 16 may be formed in manners other than coextrusion. For example, two fibers formed of dissimilar materials, that is, materials having different coefficients of thermal expansion, may be welded together under heat and pressure or joined together with an adhesive. Still further, fibers formed of two dissimilar materials may be formed so as to have cross sections that cooperate with one another and may chemically or physically interlock when pressed together.

Although the insulative material 14 is formed of first and second structural components 18, 20 having different coefficients of thermal expansion, the insulative material need not necessarily be formed of fibers. In the embodiment depicted in FIGS. 7 and 8, for example, the first structural component may include a sheet 24 formed of the first material. In this embodiment, the second structural component of the insulative material may include a plurality of pieces 26 formed of the second material disposed on the sheet and spaced apart from one another. In this regard, the pieces of the second material may be strips of the second material as shown in FIG. 7 or tabs of the second material as shown in FIG. 8, as well as pieces of the second material having a wide variety of other shapes and sizes, depending upon the application. The first and second structural components are advantageously joined to one another. For example, the first and second structural components may be welded, bonded or otherwise fused or the first and second materials may be joined by an adhesive or the like.

In the embodiment of FIG. 7, the insulative material 14 may be formed such that the sheet 24 is relatively flat or planar at room temperature, but becomes corrugated, bumpy, or otherwise deformed as the temperature varies, such as by decreases in the temperature. Multiple layers of these sheets can be combined to make a laminar material or solid that varies in thickness and/or thermal conductivity with changes in temperature.

In one embodiment, slits or other openings 28 may be defined by at least one of the first and second structural components. In the embodiment illustrated in FIG. 7, for example, the openings may be defined by both the first and second structural components. The openings may be designed to transition between the open and closed configurations in response to changes in the temperature. In this regard, the openings may be closed when the insulative material is at the neutral temperature, such as room temperature such that the insulative material is nearly watertight. See FIG. 7*a*. As the temperature decreases from the neutral temperature, however, the corrugation of the insulative material will cause the openings to open so as to permit the insulative material to be more breathable and to thereby allow water vapor transport, such as in a direction away from the wearer as would be desirable in instances in which the wearer has begun to perspire. See FIG. 7*b*.

Alternatively, the second structural component 20 may be in the form of a plurality of tabs 26 that are joined to the sheet 24 that forms the first structural member. As shown in FIG. 8, an opening 28 may be defined about the second structural member and through the first structural member with the opening being closed as shown in FIG. 8*a*, at that the neutral temperature at which the tabs in the underlying sheet remain relatively planar, but opening, at least partially, as the tabs deflect as shown in FIG. 8*b* in response to changes in the temperature, such as decreases in the temperature. In instances in which the tabs are relatively small, the resulting insulative material 14 will have a roughness that correspondingly varies with temperature. For example, the insulative material may be smoother at room temperature in which the tabs are not deflected, and rougher at temperatures above or below room temperature. The breathability of the insulative material 14 may also be modified in response to changes in the temperature as the tabs open and close.

FIG. 9 illustrates another embodiment in which the insulative material 14 is formed of two sheets 30, with one sheet formed of the first material and the other sheet formed of the second material. Each sheet generally defines one or more tabs 32. In this regard, each tab is generally defined by separating the tab from the remainder of the sheet along several edges of the tab while ensuring that the tab remains connected to the remainder of the sheet along at least one edge. In conjunction with a rectangular tab, the tab is separated from the remainder of the sheet along three edges of the tab, while remaining connected to the remainder of the sheet along the fourth edge of the tab (hereinafter referred to as the "base" of the tab). The sheets of material are assembled such that the tabs of each sheet are generally aligned with one another, but are disposed in such a manner that the free ends 32*a*, of the tabs are oppositely positioned from one another and the base 32*b*, of the tabs are also oppositely positioned from one another. The tabs are then joined, such as by stitching, welding, bonding, or by an adhesive or the like, along one or more lines or over the surface of the tabs. Although the sheets of material will remain adjacent one another with little or no air gap therebetween at a neutral temperature as shown in FIG. 9*a*,, the construction of the sheets from dissimilar materials having different coefficients of thermal expansion will result in the deflection of the tabs in such a manner as to separate the sheets and create an air gap therebetween in response to a change in temperature, such as a decrease in temperature, as shown in FIG. 9*b*. Multiple layers of these sheets can be combined to make a laminar material or solid that varies in thickness and/or thermal conductivity with changes in temperature.

While the first and second sheets 30 may be directly joined to one another by means of the respective tabs 32 in the embodiment of FIG. 9, the first and second sheets of material may be separated from one another and joined by an intermediate member 34 as shown in FIG. 10. In this embodiment, the first and second sheets may be formed of the same material with the intermediate member being formed of a different material having a different coefficient of thermal expansion. As illustrated, opposite sides and opposite ends of the intermediate member are joined to the tabs of the first and second sheets. As such, the insulative material of the embodiment of FIG. 10 can expand from a relatively collapsed configuration at a neutral temperature as shown in FIG. 10*a*, to an expanded configuration as shown in FIG. 10*b*, in response to the change in temperature, such as a decrease in temperature, with a corresponding increase in the air gap between the sheets of material. By increasing the air gap in response to a change in room temperature, the insulative properties of the insulative materials are altered As above, multiple layers of these sheets can be combined to make a laminar material or solid that varies in thickness and/or thermal conductivity with changes in temperature.

In another embodiment, the first structural component 18, such as a sheet formed of the first material, may include a plurality of pieces 38 of the second material disposed on the sheet and spaced apart from one another. In this regard, the plurality of pieces of the second material may be defined by a fiber seam that is stitched into and through the first material. By forming the fiber seam from a second material that has a greater coefficient of thermal expansion than the first material that forms the sheet, the stitch will shrink further relative to the remainder of the sheet formed of the first material such that changes in the temperature below the neutral temperature will cause the insulative material of FIG. 11*a*, to change shape in the manner shown in FIG. 11*b*, in which the sheet formed of the first material curls or spirals in three dimensions about the more thermally expansive seam. This embodiment has the special property of being thermally passive when the temperature rises above the neutral temperature. Alternately, the fiber seam may be made from a second material that has a lower thermal coefficient of expansion, which will make this embodiment thermally adaptive above the neutral temperature, and passive below it. The stitching must be anchored at least at the ends of the sheet of the first material, and preferably at numerous points along the sheet. While the seams may be stitched as described above, the seam may alternatively be formed by the pieces formed of the second material that are joined to opposite sides of the sheet in an alternating manner.

As exemplified above, the insulative material 14 may be formed in a wide variety of manners. As shown in FIG. 12, the insulative material may be formed in various shapes and sizes. In this regard, two sheets formed of the first and second materials having different coefficients of thermal expansion may be joined together, such as by an adhesive, a solvent weld, a thermal weld, etc. and be cut into strips. By forming the strips to have either a varying width along its length or a web-like shape in which the widths of the first and second materials vary differently along the length of the resulting strip, the resulting insulative material will transition from the forms depicted in FIG. 12 at a neutral temperature to a curled or at least partially curled configuration at lower temperatures. In this regard, different types of curl can be obtained by varying the material properties including, for example, the coefficients of thermal expansion of the first and second materials, or by varying the shape or bias of the cuts, or by forming the strips such that portions made of a single material alternate or are disposed in parallel to portions made of two materials such that portions that curl are placed between or parallel to portions that do not.

As described above, the insulative material 14 may have a wide variety of forms and configurations. For example, although each of the foregoing embodiments of the insulative material have been formed of two dissimilar materials with different coefficients of thermal expansion, the insulative material may be formed of three or more materials so long as the three or more materials include at least two that have different coefficients of thermal expansion so as to facilitate the change in shape, such as the curl, of the insulative material at different temperatures, such as in response to a decrease in temperature. Further, these fibers, strips, sheets, or other shapes of thermally adaptive materials described above may be disposed within standard, non-adaptive insulative materials, such that the deformation of the thermally adaptive materials increase or decrease the thermal performance of the non-adaptive materials with response to changes in temperature. For example, short segments of adaptive fibers interspersed within a yarn of non-adaptive materials will cause the yarn to expand as the temperature changes, increasing the thermal resistance of the yarn. See, for example, FIGS. 13*a*, and 13*b*, in which short segments of adaptive fibers interspersed within a yarn cause the yarn to expand from a more collapsed form at the neutral temperature as shown in FIG. 13*a*, to a more expanded for at temperatures away from the neutral temperature as shown in FIG. 13*b*.

As described above, the change in shape of the adaptive insulative material 14 in response to a change in temperature may be a thickening in the insulative material as the temperature drops below the neutral temperature. This change in shape, in turn, causes a change in the thermal conductivity of the insulative material, such as by causing the insulative material to become even more insulative. However, this same adaptive insulative material may also become thicker as the temperature climbs above the neutral temperature. The increased insulative properties occasioned by the thickening of the insulative material at higher temperatures may also be useful, such as in instances in which the insulative material is incorporated within a firefighter's protective clothing with the clothing providing more protection while the firefighter is exposed to the elevated temperatures, but then thinning out and permitting the firefighter to cool once the firefighter leaves the region in which the temperature is elevated.

Additionally, the insulative material of an alternative embodiment could be configured to become thinner as the temperature deviates, either above or below, from the neutral temperature. The insulative material of this embodiment may be formed in various manners including, for example, sewing thermally adaptive fibers, such as of the type described above, so as to be engaged with and to extend through the thickness of a non-adaptive insulative blanket. In this regard, a non-adaptive insulative blanket may have an inner surface facing the object for which insulation is desired and an opposed outer surface, typically facing the external environment. In this embodiment, thermally adaptive fibers may be sewed to the non-adaptive insulative blanket and may extend between or at least partially between the inner and outer surfaces thereof. As the temperature deviates from the neutral temperature, the thermally adaptive fibers will curl or otherwise contract along their length, thereby flattening the non-adaptive insulative blanket and making it less insulative.

As noted above in conjunction with the formation of the thermally adaptive fibers, the thermally adaptive fibers may be formed so as to be curled or otherwise contracted at the neutral temperature, but to relax and elongate, thereby expanding in length, as the temperature gets colder and falls below the neutral temperature. In this embodiment, the thermally adaptive fibers are generally formed such that the neutral temperature is set to be the coldest temperature that would be expected to be encountered. The thermally adaptive fibers may be woven into yarn and joined together randomly through bonding or entanglement, such as shown at room temperature (above the neutral temperature) in FIG. 14*a*, in which the thermally adaptive fibers are fairly tightly curled. As the temperature gets colder, the thermally adaptive fibers will relax and begin to uncurl, thereby expanding the yarn as shown in FIG. 14*b*. If desired, the insulation may be formed entirely of the thermally adaptive fibers and need not necessarily include any non-adaptive insulative material.

Still further, it is noted that certain embodiments of the thermally adaptive fibers that have been described heretofore tend to decrease in length in correspondence with an increase in the curl of the fibers. However, the thermally adaptive fibers of another embodiment may similarly curl without any corresponding decrease in the length of the fibers. Instead, the fibers of one embodiment may become thinner, in cross-section, to account for the increased curl without any decrease in the overall length of the fibers.

As described herein, the insulative material 14 is formed of first and second structural components 18, 20 having different coefficients of thermal expansion. Although the first and second structural components are generally formed of materials that are different from one another as described above, the first and second structural components may have the same chemical composition in that both components may be formed of a single material. The insulative material of this embodiment may have a portion, such as an edge, a seam or other pattern, that is transformed by crushing, melting, crimping, a chemical reaction, polymerization, radiation, photoillumination, e.g., ultraviolet curing, heat shrinking, laser sintering or the like. As a result of the collapse, the collapsed portion may have a different coefficient of thermal expansion such as a lower coefficient of thermal expansion, even though all of the insulative material remains formed of the same material. As such, the insulative material could be formed of a single material with regions having different coefficients of thermal expansion, if so desired.

As described above, the insulative material 14 may be formed to have first insulating properties at a neutral, e.g., room, temperature and other insulating properties, such as increased insulating properties, at other temperatures, such as at reduced temperatures. In order to permit the insulative material to provide appropriate insulation of an even wider range of temperatures, the insulative material may be formed of two or more layers or sets of fibers with each set of fibers having different neutral temperatures. As such, a first set of fibers may have a first neutral temperature such that decreases in the temperature below this first neutral temperature cause the first set of fibers, but not the second or other sets of fibers (at least not to the same degree or extent), to change shape, such as by curling. Further, the second set of fibers may have a second neutral temperature that is lower than the first neutral temperature. As such, a further decrease in the temperature beyond the first temperature at which the first set of fibers began to curl will cause the second set of fibers to also begin curling once the temperature falls below the second neutral temperature. As such, an insulative material formed of two or more sets of fibers having different neutral temperatures can provide additional degrees of insulation as the temperature continues to decrease, thereby offering appropriate insulation across an even wider range of temperatures. While this embodiment has been described in conjunction with an insulative material having two or more sets of fibers, this embodiment of the insulative material may also include insulative material formed in other manners, that is, other than by fibers, if so desired.

By forming the insulative material 14 in the manner described above and then disposing the insulative material in a pocket defined between the first and second clothing layer 12 as described above in conjunction with FIG. 1, the resulting article of clothing 10 can adapt to different temperatures, such as by providing more insulation as the temperature decreases or as the body temperature of the wearer decreases and providing less insulation as the temperature increases or the body temperature of the wearer increases. Further, embodiments of the insulative material also can provide increased breathability in response to changes in temperature, if desired. As also described, the insulative material may also affect the texture of the fiber with the fabric woven from fibers of the type described above being relatively smooth and flat at a neutral temperature and then becoming more wooly and textured at temperatures away from the neutral temperature. As such, summer weight clothing may automatically thicken as the temperature decreases throughout the fall, for example. In any event, the insulative material advantageously provides for more appropriate insulation to cover a wider range of temperatures as a result of the change in shape of the insulative material as the temperature changes.

While described above primarily in conjunction with clothing, the insulative material may be used in a wide variety of other applications such as spacecraft, air vehicles or the like. For example, a spacecraft may be covered with the insulative material with the behavior of the insulative material varying depending whether the insulative material is exposed to sunlight or not. In this regard, if the desire is to warm the spacecraft, the insulative material on the side of the spacecraft that is exposed to sunlight may provide little insulation since, for example, the fibers 16 that comprise the insulative material may remain straight or relatively straight. Alternatively, the insulation of the side of the spacecraft that is in the shade or is out of the direct sunlight may provide increased insulation since, for example, the fibers that comprise the insulative material may be curled so as to develop larger and/or more numerous voids between the fibers and correspondingly increase the insulative properties. If the desire is to protect the spacecraft from heating, the opposite properties may be created by varying the neutral temperatures of the insulative components, such that the side exposed to the sun is well insulated, and the side away from the sun has less insulation to increase radiation to space.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. Adaptive insulation comprising:

an insulative material formed of at least first and second structural components, wherein the first and second structural components are joined together and are comprised of first and second materials, respectively, that have different coefficients of thermal expansion such that the insulative material is configured to change shape in response to changes in temperature, wherein the insulative material is comprised of a plurality of fibers with some portion of each fiber formed of the first and second structural components, wherein each fiber is configured to curl so as to define a loop at a first temperature and to uncurl so as to straighten at a second temperature, wherein each of the plurality of fibers has a neutral temperature with the fiber configured to change shape as the temperature varies from the neutral temperature, wherein the plurality of fibers comprises first and second layers of fibers, wherein within the first layer, the plurality of fibers have a first neutral temperature and within the second layer, the plurality of fibers have a second neutral temperature, different than the first neutral temperature, and wherein the first and second layers of fibers are configured such that additional degrees of insulation are provided by the change in shape of the first and second layers of fibers; and a non-adaptive insulative material with the insulative material formed of at least the first and second structural components being integrated therewith.

2. Adaptive insulation according to claim 1 wherein the first and second materials both extend lengthwise along the respective fibers.

3. Adaptive insulation according to claim 2 wherein at least one of the first and second materials varies in at least one of relative position, shape or size in a lengthwise direction along the respective fibers.

4. Adaptive insulation according to claim 1 wherein the insulative material formed of at least the first and second structural components is bonded to portions of the non-adaptive insulative material.

5. Adaptive insulation according to claim 1 wherein the first neutral temperature is greater than the second neutral temperature, wherein the first layer of fibers is configured to change shape at a temperature between the first and second neutral temperatures while the second layer of fibers remain unchanged in shape, and wherein both the first and second layers of fibers are configured to change shape at a temperature below the second neutral temperature.

6. Adaptive insulation according to claim 1 wherein each fiber comprises an elongate member formed of one of the first and second materials and a plurality of portions formed of the other of the first and second materials, wherein the plurality of portions are positioned discontinuously along the elongate member.

7. Adaptive insulation according to claim 6 wherein the plurality of portions are positioned in an alternating manner along opposite sides of the elongate member.

8. Adaptive insulation according to claim 1 wherein each fiber comprises an elongate member formed of one of the first and second materials and surface portion formed of the other of the first and second materials that extends lengthwise along the elongate member and that has a shape or a thickness that varies along the elongate member.

9. A method of forming adaptive insulation comprising:

forming an insulative material from at least first and second structural components, wherein the first and second structural components are joined together and are comprised of first and second materials, respectively, that have different coefficients of thermal expansion such that the insulative material is configured to change shape in response to changes in temperature, wherein the insulative material is comprised of a plurality of fibers with some portion of each fiber formed of the first and second structural components, wherein each fiber is configured to curl so as to define a loop at a first temperature and to uncurl so as to straighten at a second temperature, wherein some portion of the plurality of fibers has a neutral temperature with the fiber configured to change shape as the temperature varies from the neutral temperature, wherein forming the insulative material from a plurality of fibers comprises forming the insulative material from first and second layers of fibers, wherein within the first layer, the plurality of fibers have a first neutral temperature and within the second layer, the plurality of fibers have a second neutral temperature, different than the first neutral temperature, and wherein the first and second layers of fibers are configured such that additional degrees of insulation are provided by the change in shape of the first and second sets of fibers; and integrating the insulative material formed of at least the first and second structural components with a non-adaptive insulative material.

10. A method according to claim 9 wherein integrating the adaptive insulative material with a non-adaptive insulative material comprises bonding the adaptive insulative material formed of at least the first and second structural components to portions of the non-adaptive insulative material.

11. A method according to claim 9 wherein the first neutral temperature is greater than the second neutral temperature, wherein the first layer of fibers is configured to change shape at a temperature between the first and second neutral temperatures while the second layer of fibers remain unchanged in shape, and wherein both the first and second layers of fibers are configured to change shape at a temperature below the second neutral temperature.

12. A method according to claim 9 wherein each fiber comprises an elongate member formed of one of the first and second materials and a plurality of portions formed of the other of the first and second materials, wherein the plurality of portions are positioned discontinuously along the elongate member.

13. A method according to claim 12 wherein the plurality of portions are positioned in an alternating manner along opposite sides of the elongate member.

14. A method according to claim 9 wherein each fiber comprises an elongate member formed of one of the first and second materials and surface portion formed of the other of the first and second materials that extends lengthwise along the elongate member and that has a shape or a thickness that varies along the elongate member.

15. Adaptive insulation comprising:

an insulative material formed of a plurality of fibers having at least first and second structural components, wherein the first and second structural components are joined together and are comprised of first and second materials, respectively, that have different coefficients of thermal expansion such that the insulative material is configured to change shape in response to changes in temperature, wherein the second structural component is discontinuous in a lengthwise direction along the fiber such that regions that include the second material alternate with regions that are free of the second material in the lengthwise direction, wherein each of the plurality of fibers has a neutral temperature with the fiber configured to change shape as the temperature varies from the neutral temperature, and wherein the plurality of fibers comprises first and second layers of fibers, wherein within the first layer, the plurality of fibers have a first neutral temperature and within the second layer, the plurality of fibers have a second neutral temperature, different than the first neutral temperature, and that are configured such that additional degrees of insulation are provided by the change in shape of the first and second layers of fibers; and a non-adaptive insulative material with the insulative material formed of at least the first and second structural components being integrated therewith.

16. Adaptive insulation according to claim 15 wherein the first neutral temperature is greater than the second neutral temperature, wherein the first layer of fibers is configured to change shape at a temperature between the first and second neutral temperatures while the second layer of fibers remain unchanged in shape, and wherein both the first and second layers of fibers are configured to change shape at a temperature below the second neutral temperature.

17. Adaptive insulation according to claim 15 wherein each fiber comprises an elongate member formed of one of the first and second materials and a plurality of portions formed of the other of the first and second materials, wherein the plurality of portions are positioned discontinuously along the elongate member.

18. Adaptive insulation according to claim 17 wherein the plurality of portions are positioned in an alternating manner along opposite sides of the elongate member.

19. Adaptive insulation according to claim 15 wherein each fiber comprises an elongate member formed of one of the first and second materials and surface portion formed of the other of the first and second materials that extends lengthwise along the elongate member and that has a shape or a thickness that varies along the elongate member.

* * * * *